US011691068B2

(12) United States Patent
Munim

(10) Patent No.: US 11,691,068 B2
(45) Date of Patent: Jul. 4, 2023

(54) SKIS COMPRISING A SERIES OF PARALLEL AIR TUNNELS

(71) Applicant: Amjad Munim, Fort Lauderdale, FL (US)

(72) Inventor: Amjad Munim, Fort Lauderdale, FL (US)

( * ) Notice: Subject to any disclaimer, the term of this patent is extended or adjusted under 35 U.S.C. 154(b) by 0 days.

(21) Appl. No.: 17/740,420

(22) Filed: May 10, 2022

(65) Prior Publication Data

US 2022/0355185 A1 Nov. 10, 2022

Related U.S. Application Data

(60) Provisional application No. 63/186,277, filed on May 10, 2021.

(51) Int. Cl.
*A63C 5/04* (2006.01)
*A63C 11/00* (2006.01)

(52) U.S. Cl.
CPC ..... *A63C 5/0417* (2013.01); *A63C 11/00* (2013.01)

(58) Field of Classification Search
CPC ..... A63C 5/00; A63C 5/04; A63C 5/0422; A63C 5/0428; A63C 5/044; A63C 5/0417; A63C 5/052; A63C 11/00; B63B 32/30; B63B 32/50
See application file for complete search history.

(56) References Cited

U.S. PATENT DOCUMENTS 2,531,946 A * 11/1950 Parker ..... B63B 32/50 52/783.17
2,926,364 A * 3/1960 Cox ..... B63B 32/30 280/610
3,118,157 A * 1/1964 Houser ..... B63B 32/30 280/610
3,414,919 A * 12/1968 Gust ..... B63B 32/40 441/74
3,534,972 A * 10/1970 Salerno ..... A63C 5/0422 D21/766
3,933,360 A * 1/1976 Arai ..... A63C 5/052 280/609
6,189,912 B1 * 2/2001 Ritzinger ..... A63C 5/03 280/18
6,290,249 B1 * 9/2001 Wolf ..... A63C 5/126 280/600
7,213,828 B2 * 5/2007 Riepler ..... A63C 5/04 280/14.22
8,128,108 B2 * 3/2012 Madrid ..... A63C 17/26 280/87.041
2005/0127638 A1 * 6/2005 Feichtlbauer ..... A63C 5/0422 280/610

* cited by examiner

*Primary Examiner* — Brian L Swenson
(74) *Attorney, Agent, or Firm* — Ashley D. Johnson; Dogwood Patent and Trademark Law

(57) ABSTRACT

The presently disclosed subject matter is directed to a pair of skis that exhibit increased speed compared to prior art skis. Specifically, each ski exhibits a reduced projected frontal area to decrease drag force (and thereby increase speed). Each ski includes a plurality of parallel air tunnels that run along the length of the ski from the front end to the rear end. The tunnels enable a significant portion of the air that contacts the front end of the skis to simply pass through the skis. In this way, the projected frontal area of the skis is considerably reduced compared to conventional solid skis. As a result, the ski exhibits increased speed based on the decrease in drag force compared to prior art skis.

18 Claims, 9 Drawing Sheets

SKIS COMPRISING A SERIES OF PARALLEL AIR TUNNELS

CROSS-REFERENCE TO RELATED APPLICATIONS

This application claims priority to U.S. Provisional Patent Application No. 63/186,277, filed May 10, 2021, the entire content of which is hereby incorporated by reference.

TECHNICAL FIELD

The presently disclosed subject matter is directed to a pair of skis, each comprising a series of parallel air tunnels.

BACKGROUND

In the United States, participation in skiing and other snow related sports has grown at a tremendous pace. Literally millions of people flock to ski resorts each winter to enjoy the thrill of skiing and other related activities. The basic flat design of the ski dates back more than one hundred years and is quite adequate for its initial intended purpose of floating on (or pushing against) powder snow and soft packed snow. As skiing has evolved into a competitive and recreational sport, the typical ski terrain has shifted from powder and soft packed snow to predominantly hard packed snow and ice. To deal with these conditions, new technologies and material advancements have been introduced. For instance, ski equipment has been improved through the use of carbon fiber, GORTEX™, titanium, and KEVLAR™. However, the impedance to speed when skiing continues to be air resistance. For a skier, the drag force (FD) can be calculated using the following formula:

$$FD=\tfrac{1}{2}*C*P*A*V2$$

In the disclosed formula, "C" refers to the drag coefficient, which is typically around 0.4-1 for a downhill skier. "P" refers to the density of air (which is about 0.7364 kg/m$^3$ at 5000 feet). "A" refers to the projected frontal area that includes the skier and the equipment (including the skis), which is about 0.6 m$^2$ for an average adult skier in a proper downhill position. "V" refers to velocity. Thus, when the drag coefficient is 0.6, density of air is 0.7364 kg/m$^3$, projected frontal area is 0.6 m$^2$, and velocity is 27.77 meters/second:

$$FD=(0.5)*(0.6)*(0.7364)*(0.6)=0.13255*(27.77)(2)=7.36 \text{ Newtons}$$

FD is reduced if the projected frontal area (A) is reduced, we are concentrating on the portion of A contributed by the skis. If A is reduced for a pair of skis by about 20 percent and nothing else changes, the velocity of the skier can be increased by 5%, which can be confirmed in a wind tunnel, ski slopes, or other suitable testing area. Specifically, if A is reduced from 0.6 m$^2$ to 0.5 m$^2$, the speed of that unit will increase from 100 km/hour (27.77 m/s) to 120 km/hour (33.5 m/s) (all other factors are constant). As shown:

$$FD=(0.5)*(0.6)*(0.7364)*(0.5)*(33.5)(2)=7.4 \text{ Newtons}$$

It would therefore be beneficial to provide a ski with a reduced projected frontal area to decrease drag force (and thereby increase speed).

SUMMARY

In some embodiments, the presently disclosed subject matter is directed to a ski comprising a top face and an opposed bottom face, a pair of side faces, and a front face and an opposed rear face with a defined length therebetween. The ski further includes an interior core defined by a series of hollow parallel tunnels, wherein each tunnel includes a first opening in fluid communication with the front face of the ski and a second opening in fluid communication with the rear face of the ski, wherein each tunnel spans length of the ski.

In some embodiments, the ski comprises a reduced projected front area compared to skis configured without the tunnels.

In some embodiments, the front face, rear face, or both of the ski are curved in an upward direction.

In some embodiments, the ski comprises a length of about 80-200 cm, a width of about 10-20 centimeters, and a thickness of about 0.5-5 cm.

In some embodiments, each tunnel is embedded integrally within the core of the ski.

In some embodiments, each tunnel has about the same cross-sectional shape.

In some embodiments, at least one tunnel differs in cross-sectional shape compared to at least one other tunnel.

In some embodiments, each tunnel has a diameter of about 0.1-1 cm.

In some embodiments, each tunnel comprises a diameter that tapers or broadens from the first opening to the second opening.

In some embodiments, the ski comprises about 4-12 tunnels.

In some embodiments, the tunnels are equally spaced to adjacent tunnels.

In some embodiments, the ski includes one or more heaters positioned on an inside surface, outside surface, or both of at least one tunnel.

In some embodiments, the one or more heaters raise the temperature within the core of the ski at least about 5-50° F.

In some embodiments, the presently disclosed subject matter is directed to a method of reducing the drag force of a ski. Particularly, the method comprises constructing a ski comprising a top face and an opposed bottom face, a pair of side faces; a front face and an opposed rear face with a defined length therebetween, and an interior core. The method includes positioning a plurality of tunnels within the interior core, wherein each tunnel is defined by a first opening in fluid communication with the front face of the ski and a second opening in fluid communication with the rear face of the ski, wherein each tunnel spans length of the ski. The plurality of tunnels reduces the drag force of the ski compared to skis that lack interior tunnels.

In some embodiments, the drag force is reduced by about 1-10 percent compared to skis without internal tunnels.

In some embodiments, the reduced drag force results in an increased velocity of the ski during use.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "an assembly" can include a plurality of such assemblies, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−0.1-20% from the specified amount, as such variations are appropriate in the disclosed packages and methods.

Figure 1:
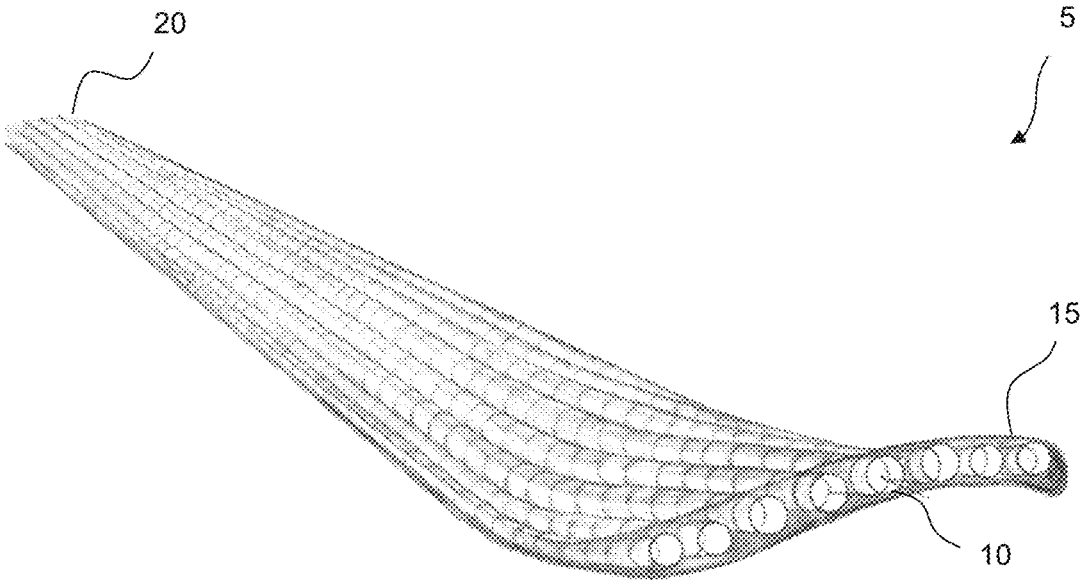
FIG. 1 is a perspective view of a ski comprising a series of internal hollow tunnels in accordance with some embodiments of the presently disclosed subject matter.

The presently disclosed subject matter is directed to a pair of skis that exhibit increased speed compared to prior art skis. Specifically, each ski exhibits a reduced projected frontal area to decrease drag force (and thereby increase speed). As shown in FIG. 1, each ski 5 includes a plurality of parallel air tunnels 10 that run along the length of the ski from front end 15 to rear end 20. As described in more detail herein below, tunnels 10 enable a significant portion of the air that contacts the front end of the skis to simply pass through the skis. In this way, the projected frontal area of the skis is considerably reduced compared to conventional solid skis. As a result, the ski exhibits increased speed based on the decrease in drag force compared to prior art skis.

As used herein, the term "ski" broadly refers to any type of structure or apparatus used to mobilize a user over snow and/or ice. Thus, the term "ski" includes (but is not limited to) cross-country skis, downhill skis, all mountain skis, all terrain skis, free skis, freeride skis, mid-fat skis, groomed snow skis, powder skis, freestyle skis, extreme carving skis, racing skis, skiboards, backcountry skis, track skis, telemark skis, randonee skis, mountaineering skis, alpine skis, and the like. Further, although the present disclosure is directed primarily to skis, it should be appreciated that the configuration can be equally applied to snowboards and other similar devices.

Figure 2A:
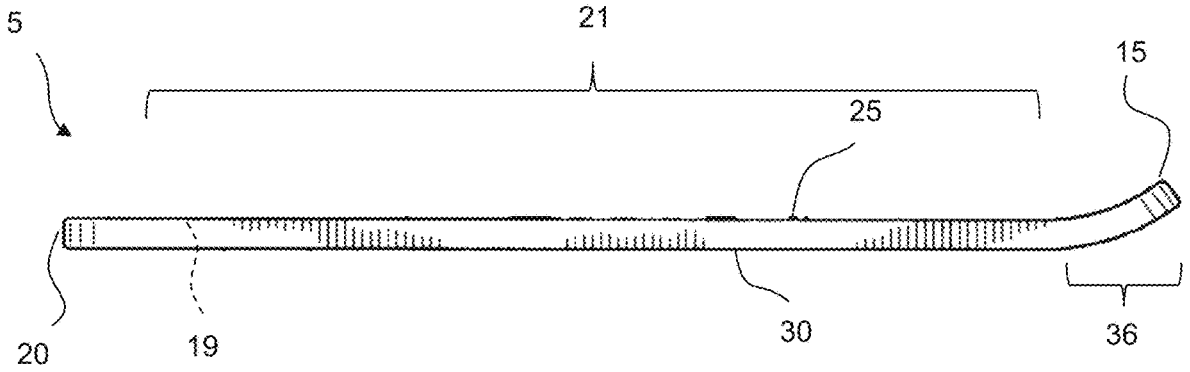
FIG. 2*a* is a side plan view of a ski in accordance with some embodiments of the presently disclosed subject matter.
Figure 2B:
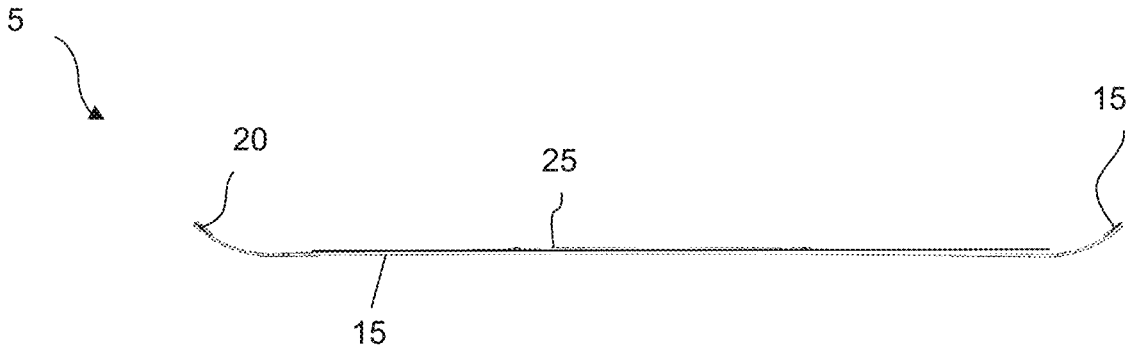
FIG. 2*b* is a side plan view of a ski with raised front and rear ends in accordance with some embodiments of the presently disclosed subject matter.

FIG. 2*a* illustrates a side view of ski 5 comprising top surface 25 in direct contact with the user's ski boot and bottom surface 30 that contacts a support surface (e.g., snow). Because bottom surface 30 contacts the snow during skiing, it is configured to be smooth, enabling users to glide over the snow. The bottom surface can be contoured and shaped as desired by the user and is not limited to the flat design shown in the Figures. Core 19 is configured within the top and bottom surfaces of the ski. Ski 5 further includes front end 15, opposed rear end 20, and elongated body 21 extending between the front and rear ends. The ski front end is the end directed towards the leading end of the ski when in use. Likewise, rear end 20 of the ski refers to the trailing end of the ski when in use. The front end of ski 5 can be curved upward to help the skis ride over the surface of the snow. In some embodiments, the tail end of the ski can also be curved in an upward direction, as shown in FIG. 2*b*.

Top and/or bottom surfaces 25, 30 can include an optional coating to provide a desired look to ski 5. Thus, the coating can include any color, pattern, words, or combinations thereof.

Figure 3:
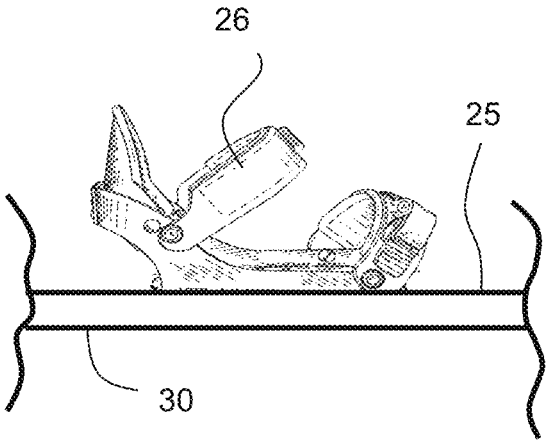
FIG. 3 is a side plan view of a ski that includes bindings in accordance with some embodiments of the presently disclosed subject matter.

Top surface 25 of the ski can include binding 26 for attaching the ski to the boots of a user, as shown in FIG. 3. Binding 26 can have any of a wide variety of configurations and is not limited to the embodiment of FIG. 3. In some embodiments, the binding can be positioned slightly behind a central point of the ski in some embodiments. Optionally, the binding can be adjusted in the longitudinal direction of the ski to accommodate user preferences, racing style, and the like.

Figure 4:
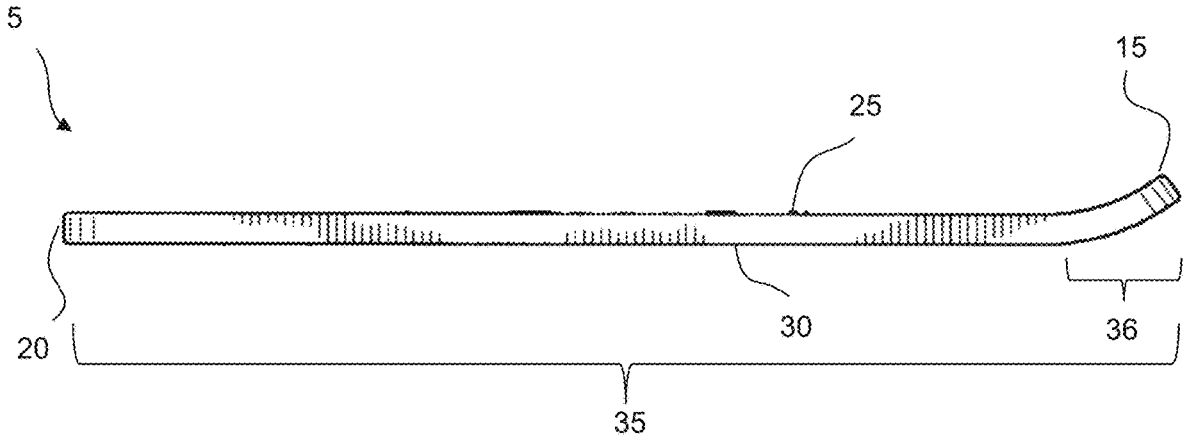
FIG. 4 is a side plan view of a ski in accordance with some embodiments of the presently disclosed subject matter.

The disclosed ski also includes length 35 that spans the distance between the front and rear ends, as shown in FIG. 4. The term "length" refers to the longest horizontal distance that spans from front end 15 to rear end 20. In some embodiments, ski 5 can have a length of about 80-200 centimeters (e.g., at least/no more than about 80, 90, 100, 110, 115, 120, 130, 135, 140, 145, 150, 155, 160, 165, 170, 175, 180, 185, 190, 195, or 200 cm). However, it should be appreciated that the length of ski 5 is not limited and can be outside the range given herein.

Figure 5A:
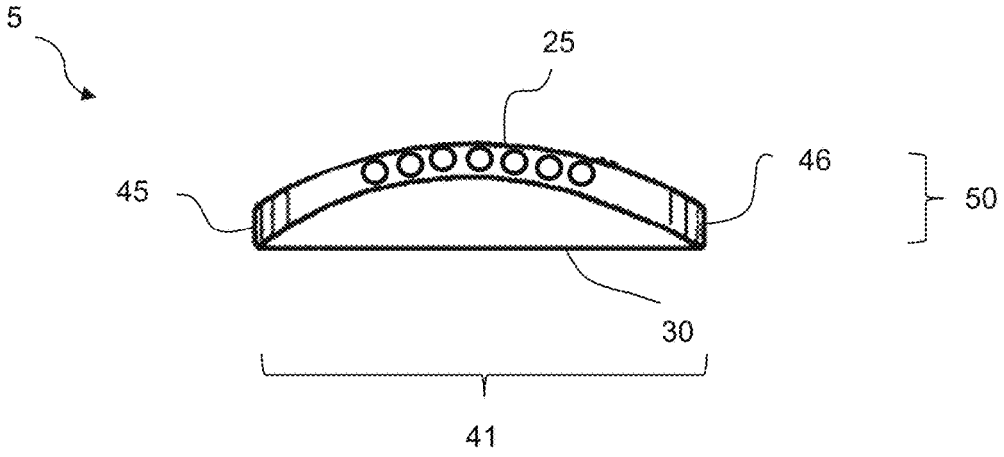
FIG. 5*a* is a front plan view of a ski in accordance with some embodiments of the presently disclosed subject matter.
Figure 5B:
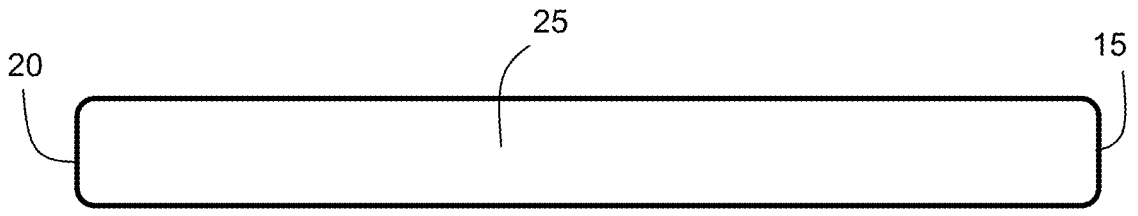
FIG. 5*b* is a top plan view of a ski with a constant width in accordance with some embodiments of the presently disclosed subject matter.
Figure 5C:
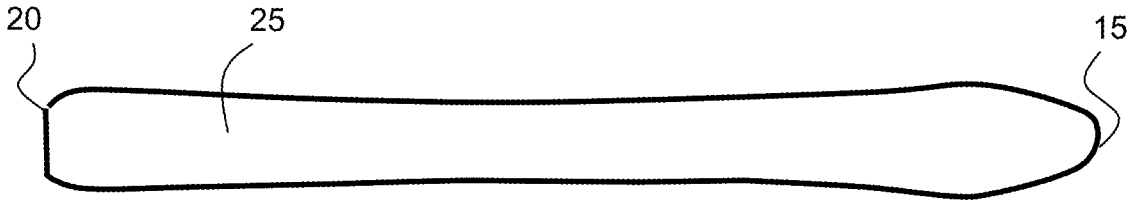
FIG. 5*c* is a top plan view of a narrowing width in accordance with some embodiments of the presently disclosed subject matter.

Ski 5 further includes left and right lateral edges 45, 46 with width 41 therebetween, as shown in FIG. 5*a*. The term "width" refers to the longest straight-line distance between right and left side edges 45, 46. In some embodiments, ski 5 can have a width of about 10-20 centimeters (e.g., at least/no more than about 10, 11, 12, 13, 14, 15, 16, 17, 18, 19, or 20 cm). However, it should be appreciated that the width of the ski can be outside the range given herein. In some embodiments, the width of ski 5 is uniform along body 21, as shown in the top plan view of FIG. 5*b*. However, the width of ski 5 can vary as it travels along the ski body, as illustrated in the embodiment of FIG. 5*c*. Particularly, the lateral side edges of the ski have a concave, curved shape (referred to as "side cut"). Thus, the side contour of ski 5 can have any of a wide variety of configurations, such as a simple arc, a combination of several arcs, a simple non-linear curve, or combinations thereof. Further, the width of the ski at front end 15 can differ from the width of rear end 20. For example, the front width dimension can be slightly greater (e.g., 5% or less) than the rear width dimension.

Figure 6:
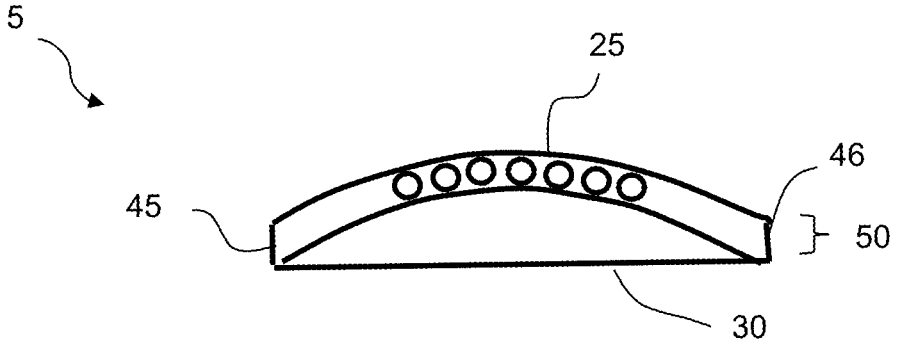
FIG. 6 is a front plan view of a ski comprising a width in accordance with some embodiments of the presently disclosed subject matter.

Ski 5 can have any suitable thickness 50, as shown in FIG. 6. The term "thickness" refers to the longest vertical distance between the ski top and bottom surfaces 25, 30. For example, the ski can have a thickness of about 0.5-5 centimeters (e.g., at least/no more than about 0.5, 1, 1.5, 2, 2.5, 3, 3.5, 4, 4.5, or 5 cm). However, it should be appreciated that ski 5 is not limited and can include a thickness outside the range given herein.

Figure 7A:
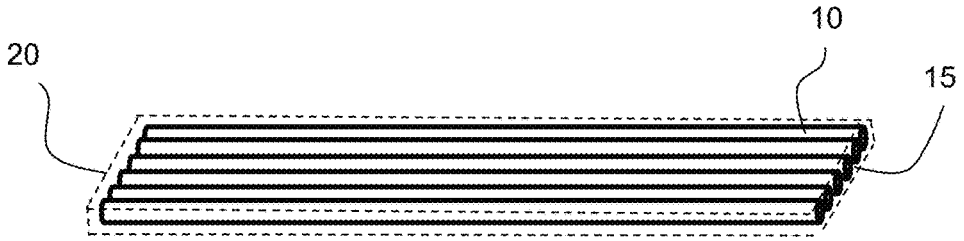
FIG. 7*a* is a perspective view of a ski comprising internal tunnels in accordance with some embodiments of the presently disclosed subject matter.
Figure 7B:
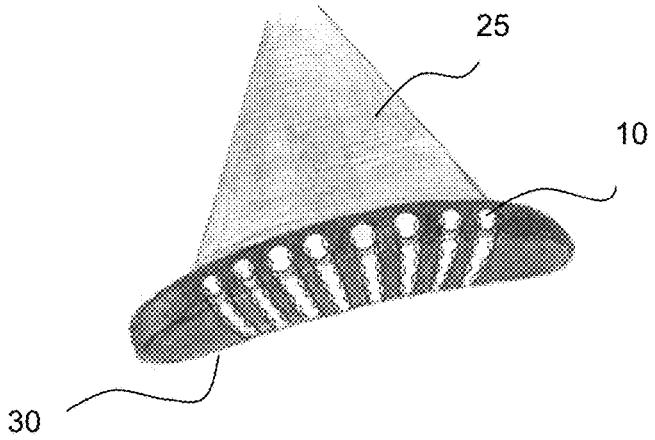
FIG. 7*b* is a front perspective view of a ski comprising internal tunnels in accordance with some embodiments of the presently disclosed subject matter.
Figure 8A:
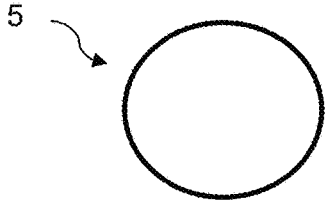
FIGS. 8*a*-8*i* are cross-sectional views of ski tunnels in accordance with some embodiments of the presently disclosed subject matter.
Figure 8B:
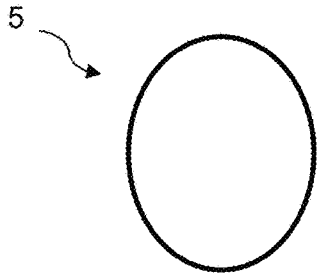
Figure 8C:
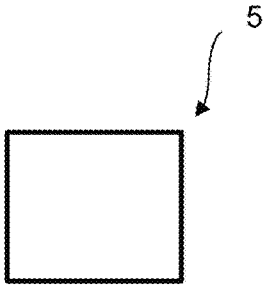
Figure 8D:
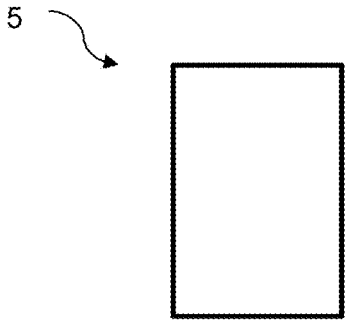
Figure 8E:
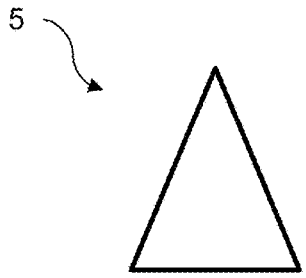
Figure 8F:
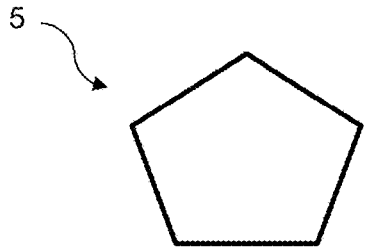
Figure 8G:
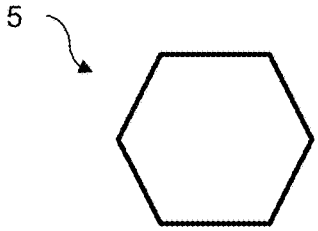
Figure 8H:
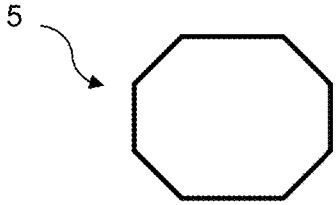
Figure 8I:
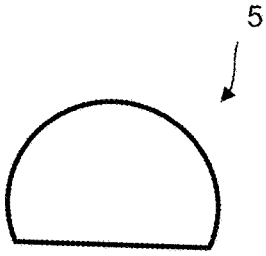

The interior of ski 5 comprises core 19 defined by a series of tunnels 10. The core of ski 5 can be any suitable material, such as wood, foam, plastic, fiberglass, carbon composite, synthetic materials, metal alloys (such as aluminium, titanium, magnesium, graphene, tungsten, steel), or combinations thereof. The core can be sandwiched between one or more structural layers (e.g., top layer 25 and bottom layer 30 (and/or between side layers positioned on each side of the ski). As set forth above, the ski includes a series of tunnels 10 configured within the core that run the full length of the ski. The term "tunnel" refers to an open conduit that allows passage of one or more materials, such as (but not limited to) air. Each tunnel 10 is formed as an elongated hollow passage within the interior of the ski, as shown in FIGS. 7*a* and 7*b*. Thus, each tunnel is embedded integrally within the ski body. In some embodiments, the tunnels are adjacent or directly adjacent to the interior surface of the top and bottom surfaces of the skis (e.g., there is minimal or no space between the tunnels and the adjacent face of the skis). Thus, the diameter of the skis can be about the same as the thickness of the skis (e.g., about 0.1, 1, 5, 10, 15, 20, or 25 percent less).

Figure 9:
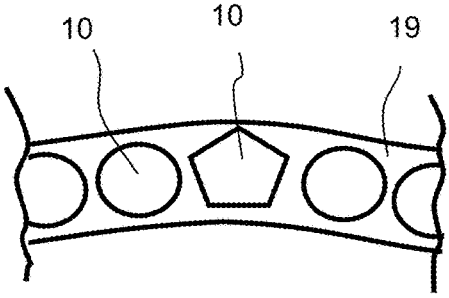
FIG. 9 is a cross-sectional view of a ski comprising a series of non-uniformly shaped tunnels in accordance with some embodiments of the presently disclosed subject matter.

Tunnels 10 can be configured with any desired cross-sectional shape. For example, the tunnels can have a circular, oval, square, rectangular, triangular, pentagonal, hexagon, octagonal, or abstract shape, as shown in FIG. 8*a*-8*i*. However, it should be appreciated that the cross-sectional shape of each tunnel is not limited and can be configured in any desired shape. In some embodiments, each tunnel is configured in about the same shape. In other embodiments, at least one tunnel cross-sectional shape can differ from at least one other tunnel, as shown in FIG. 9. Such an embodiment is believed to help with wind resistance.

Figure 10A:
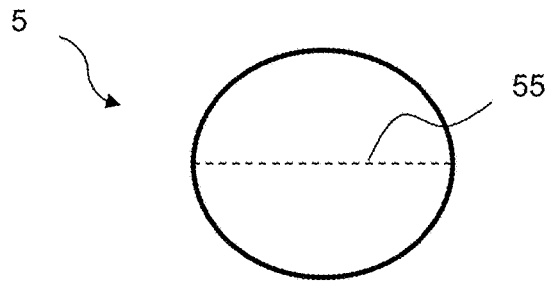
FIG. 10*a* is a cross-sectional view of a tunnel comprising a diameter in accordance with some embodiments of the presently disclosed subject matter.
Figure 10B:
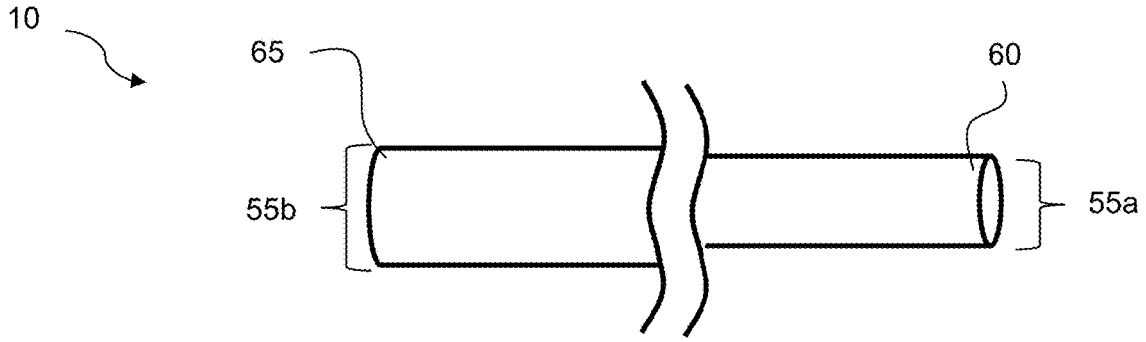
FIG. 10*b* is a fragmentary perspective view of a tunnel comprising a first end with a first diameter and a second end with a second diameter in accordance with some embodiments of the presently disclosed subject matter.
Figure 10C:
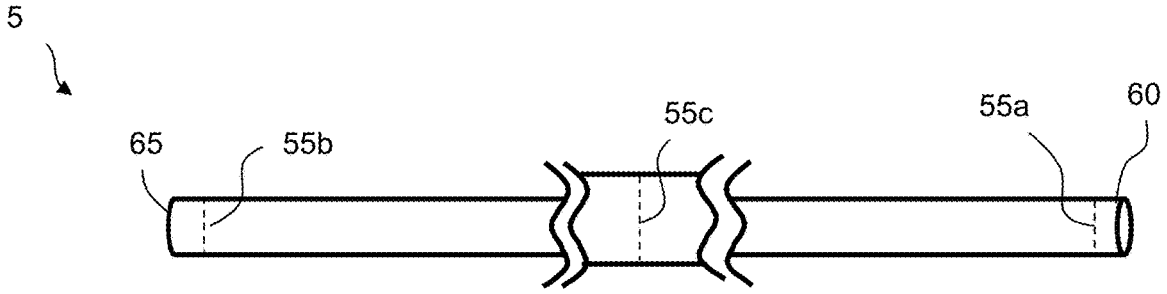
FIG. 10*c* is a fragmentary perspective view of a tunnel comprising first and second ends with diameters that differ from the diameter of a middle portion in accordance with some embodiments of the presently disclosed subject matter.

Each tunnel can have diameter 55 of about 0.1-1 centimeters (e.g., at least/no more than about 0.1, 0.2, 0.3, 0.4, 0.5, 0.6, 0.7, 0.8, 0.9, or 1 centimeters). The term "diameter" refers to the diameter of a cross-section of a tunnel (e.g., the longest straight-line distance passing through the center of the cross-section), as shown in FIG. 10*a*. In some embodiments, the diameter of each tunnel is constant along the length of the tunnel. In other embodiments, the diameter can taper or increase as it passes from front end 15 to rear end 20. Thus, diameter 55*a* at tunnel first end 60 can differ from the diameter 55*b* at second end 65, as shown in FIG. 10*b*. In other embodiments, the diameter of tunnel 10 is constant at the first and second ends of the ski, but tapers or broadens along the length of the tunnel (55*c*), as shown in FIG. 10*c*. The difference in the maximum and minimum tunnel diameter can be about +/−0.1-10 percent (e.g., at least/no more than about 0.4, 0.5, 1, 1.5, 2, 2.5, 3, 3.5, 4, 4.5, 5, 5.5, 6, 6.5, 7, 7.5, 8, 8.5, 9, 9.5, or 10).

Ski 5 can include any desired number of tunnels 10. For example, in some embodiments, the ski can include about 4-12 tunnels, although fewer or greater numbers of tunnels can be included within the scope of the presently disclosed subject matter.

Figure 11A:
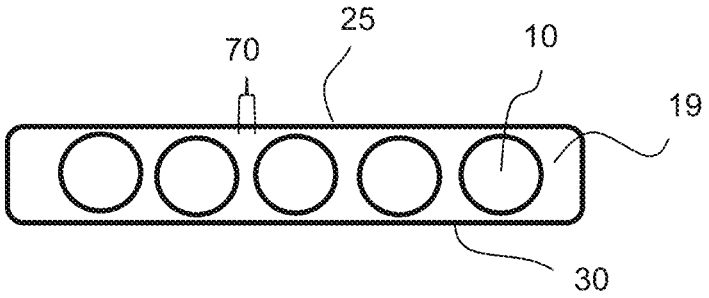
FIG. 11*a* is a cross-sectional view of a ski comprising a series of evenly spaced tunnels in accordance with some embodiments of the presently disclosed subject matter.
Figure 11B:
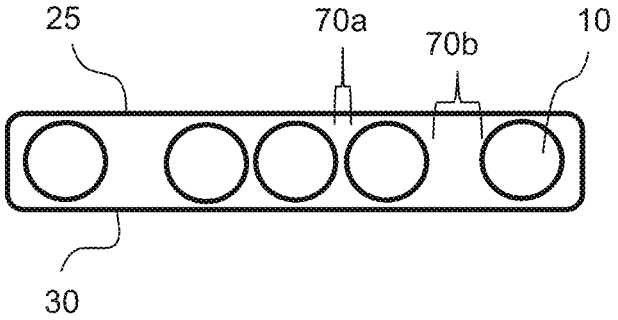
FIG. 11*b* is a cross-sectional view of a ski comprising a series of non-uniformly spaced tunnels in accordance with some embodiments of the presently disclosed subject matter.

As set forth above, tunnels 10 are parallel or substantially parallel with each other. The term "parallel" refers to a geometry in which two axes are equidistant from each other at all points. The term "substantially parallel" refers to geometry that includes some deviations from absolute parallelism. In some embodiments, each tunnel can be separated from at least one other tunnel by distance 70 of about 0.01-5 centimeters. The tunnels can be equally spaced apart from adjacent tunnels, as shown in FIG. 11*a*. Alternatively, the tunnels can be closer or farther spaced apart (70*a*, 70*b*) in different sections of ski 5 (e.g., the edges versus the middle portion), as shown in the embodiment of FIG. 11*b*.

Tunnels 10 can be constructed from any suitable material. For example, the tunnels can be formed from metal (e.g., stainless steel, copper, aluminium), plastic, wood, foam, fiberglass, carbon composite, synthetic materials, metal alloys (such as aluminium, titanium, magnesium, graphene, tungsten, steel), or combinations thereof.

In some embodiments, the tunnels can include one or more heaters to reduce the incidence of snow and/or ice from blocking the tunnels. The term "heater" refers to any heatgenerating or heat-transfer element that raises the temperature of the tunnels and/or the air within the tunnels. Suitable heaters can therefore include (but are not limited to) electric heaters, electronic chips, heated fluid, heat exchange heaters, and the like. Any suitable heating filament can be used. The heaters can be powered using any conventional methods, such as (but not limited to) batteries, solar power, electrical power, and the like. It should be appreciated that the presently disclosed subject matter is not limited and can use any device, electronics, or machinery to heat up the air tunnels and facilitate air movement and snow clearance from the air tunnels.

Figure 12A:
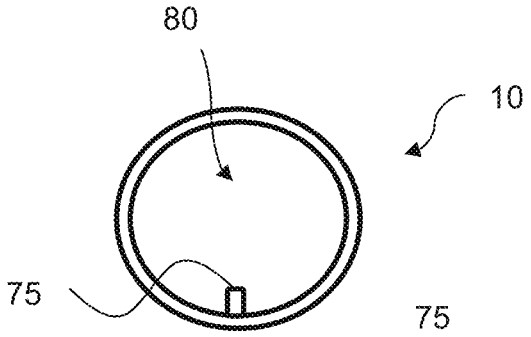
FIG. 12*a* is a cross-sectional view of a tunnel comprising an internal heating element in accordance with some embodiments of the presently disclosed subject matter.
Figure 12B:
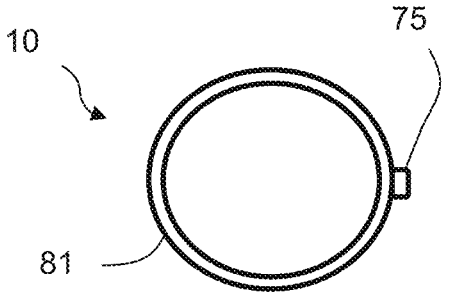
FIG. 12*b* is a cross-sectional view of a tunnel comprising an external heating element in accordance with some embodiments of the presently disclosed subject matter.

Heater 75 can be positioned within tunnel interior 80 or on external surface 81 of the tunnel, as illustrated in FIGS. 12*a* and 12*b*. The heater can be maintained on the tunnel using any conventional technique, such as the use of adhesives, welding, fasteners, VELCRO®, snap-fit attachment, pressure-fit attachment, magnets, and the like.

Figure 12C:
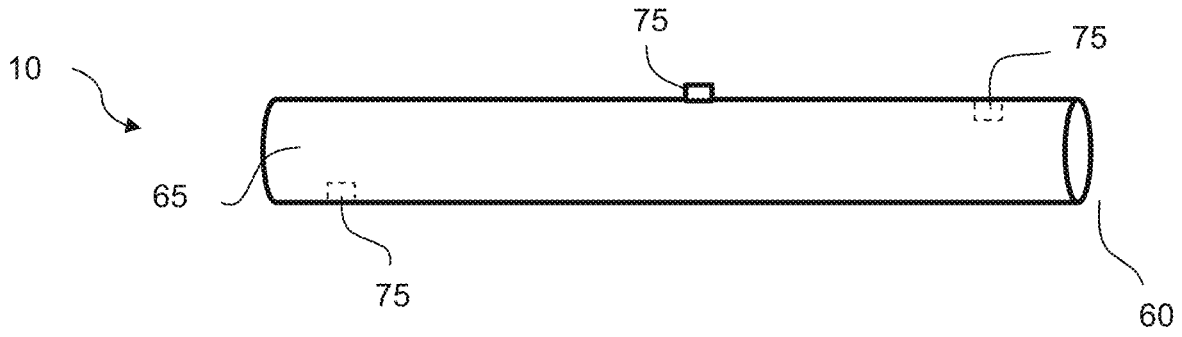
FIG. 12*c* is a perspective view of a tunnel comprising both internal and external heating elements in accordance with some embodiments of the presently disclosed subject matter.

In some embodiments, ski 5 can include a plurality of heaters 75, as shown in FIG. 12*c*. For example, each tunnel can include one or more heaters. For example, one or more heaters can be positioned at or adjacent to first and/or second ends 60, 65. Alternatively or in addition, one or more heaters can be positioned along the interior or exterior length of the tunnel(s).

Heaters 75 can raise the temperature within the interior of ski 5 to prevent and/or reduce the incidence of snow and ice from being trapped within the tunnels. In this way, any snow or ice that accumulates within the interior of the tunnel can be quickly and easily melted. Therefore, the heaters can raise the temperature of the tunnels and/or of the air within the interior of the tunnels at least about 5-50° F. (at least about 5, 10, 15, 20, 25, 30, 35, 40, 45, or 50° F. However, it should be appreciated that heaters 75 can vary and some may be configured to raise the temperature of the tunnel or within the interior of tunnel 10 more than 50° F.

Ski 5 can be constructed using any standard method. For example, the top and bottom surfaces of the ski can be bonded together along the entire perimeter via bonding, welding, the use of adhesives, lamination, or combinations thereof. In some embodiments, the ski can be molded to provide a hollow chamber for insertion of tunnels 10. The skis can be molded using vacuum, thermoforming, drape, pressure, and other conventional procedures. In some embodiments, core 19 is configured within the ski interior. The vibration and shock dampening characteristics, weight, balance, etc. can be controlled and varied by introducing a suitable filler within the ski core. Such fillers are well known in the art.

The tunnels are configured within the core using standard techniques, such as molding, adhesive, the formation of a sleeve, and the like. In some embodiments, each tunnel is fixed in position within core 19 using adhesives, molding, magnets, and the like.

Advantageously, tunnels 10 configured within the interior of ski 5 serve to reduce air resistance of the ski. The term "air resistance" refers to the resistance caused by the friction in a direction opposite to that of the movement of the center of gravity for a moving body in a fluid (e.g., air). As set forth above, the drag force of a ski relates to the drag coefficient (C), density of air (P), projected frontal area (A), and velocity (V). The term "drag coefficient" refers to a dimensionless quantity used to quantify to drag or resistance of an object in a fluid environment, such as air. The drag coefficient can be calculated using a constant reference area or profile). The density of air is about 0.7364 kg/m$^3$ at 5000 feet. The projected frontal area includes the skier and equipment (including the skis). The projected frontal area is about 0.6 m$^2$ for an average adult skier in proper downhill position. The term "velocity" refers to the change of an object's position with respect to time.

It has been determined that when the projected frontal area of the skier is reduced through skis 5, the velocity of the skier can increase by at least 5 percent. Specifically, the open tunnel structure of the skis reduces the projected frontal area, which increases the velocity of the skier. For example, if the projected frontal area is reduced from 0.6 m$^2$ to 0.5 m$^2$, the speed of the skier will increase from 100 km/hour (27.77 m/s) to 120 km/hour (33.5 m/s) (all other factors are constant). As shown:

$$FD=(0.5)*(0.6)*(0.7364)*(0.5)*(33.5)(2)=7.4 \text{ Newtons}$$

Such results can easily be tested using wind tunnels, ski slopes, and the like.

The disclosed skis are therefore capable of increasing the velocity of the skier using tunnels 10. In use, as the skier travels down a mountain wearing skis 5, air travels through tunnels 10. Thus, the front of the ski reduces drag force, thereby increasing velocity. With prior art skis, the air must travel around the skis which slows down the skier.

While the foregoing description and figures are directed toward the preferred embodiment in accordance with the present invention, it should be appreciated that numerous modifications can be made to each of the components of the soap holder 10 as discussed above. Indeed, such modifications are encouraged to be in the materials, structure and arrangement of the disclosed embodiments of the present invention without departing from the spirit and scope of the same. Thus, the foregoing description of the preferred embodiments should be taken by way of illustration rather than by way of limitation, as the present invention is defined by the claims set forth below.

What is claimed is:

1. A ski comprising:

a top face and an opposed bottom face;

a pair of side faces; and a front face and an opposed rear face with a defined length therebetween;

an interior core defined by a series of hollow parallel tunnels, wherein each tunnel includes a first opening in fluid communication with the front face of the ski and a second opening in fluid communication with the rear face of the ski, wherein each tunnel spans length of the ski; and one or more heaters positioned on an inside surface, outside surface, of both of at least one tunnel.

2. The ski of claim 1, comprising a reduced projected front area compared to skis configured without the tunnels.

3. The ski of claim 1, wherein the front face, rear face, or both are curved in an upward direction.

4. The ski of claim 1 with a length of about 80-200 cm, a width of about 10-20 centimeters, and a thickness of about 0.5-5 cm.

5. The ski of claim 1, wherein each tunnel is embedded integrally within the core of the ski.

6. The ski of claim 1, wherein each tunnel has about the same cross-sectional shape.

7. The ski of claim 1, wherein at least one tunnel differs in cross-sectional shape compared to at least one other tunnel.

8. The ski of claim 1, wherein each tunnel has a diameter of about 0.1-1 cm.

9. The ski of claim 1, wherein each tunnel comprises a diameter that tapers or broadens from the first opening to the second opening.

10. The ski of claim 1, comprising about 4-12 tunnels.

11. The ski of claim 1, wherein the tunnels are equally spaced to adjacent tunnels.

12. The ski of claim 1, where the one or more heaters raise the temperature within the core of the ski at least about 5-50° F.

13. A method of reducing the drag force of a ski, the method comprising:

constructing a ski comprising a top face and an opposed bottom face, a pair of side faces; a front face and an opposed rear face with a defined length therebetween, and an interior core;

positioning a plurality of tunnels within the interior core, wherein each tunnel is defined by a first opening in fluid communication with the front face of the ski and a second opening in fluid communication with the rear face of the ski, wherein each tunnel spans length of the ski;

positioning one or more heaters on an inside surface, outside surface, of both of at least one tunnel;

wherein the plurality of tunnels reduces the drag force of the ski compared to skis that lack interior tunnels.

14. The method of claim 13, wherein the ski comprises a reduced projected front area compared to skis configured without the tunnels.

15. The method of claim 13, wherein the ski comprises about 4-12 tunnels.

16. The method of claim 13, where the one or more heaters raise the temperature within the core of the ski at least about 5-50° F.

17. The method of claim 13, wherein the drag force is reduced by about 1-10 percent compared to skis without internal tunnels.

18. The method of claim 13, wherein the reduced drag force results in an increased velocity of the ski during use.

* * * * *